US005469901A

United States Patent [19]

Leguin

[11] Patent Number: 5,469,901

[45] Date of Patent: Nov. 28, 1995

[54] DOUBLE ACTION DISC HOG WITH CHIP SIZING GRATE

[76] Inventor: Dana Leguin, Rte. 4, Box 280, Summerville, Ga. 30747

[21] Appl. No.: 206,713

[22] Filed: Mar. 7, 1994

[51] Int. Cl.[6] ..... B27C 1/00

[52] U.S. Cl. ..... 144/163; 144/176; 144/162 R; 144/241; 144/373; 241/69; 241/74; 241/78; 241/92; 241/278.1

[58] Field of Search ..... 241/68, 69, 70, 241/74, 78, 79, 92, 277, 278.1; 144/162 R, 163, 172, 174, 176, 195, 118, 241, 373

[56] References Cited

U.S. PATENT DOCUMENTS

| | | | |
|---|---|---|---|
| 1,195,774 | 8/1916 | Brown, Jr. . | |
| 1,418,735 | 6/1922 | Plaisted . | |
| 1,420,355 | 6/1922 | Williams . | |
| 2,034,951 | 3/1936 | McArdle et al. | 83/62 |
| 2,183,224 | 12/1939 | Norman | 144/176 |
| 2,655,319 | 10/1953 | Johnson | 241/92 |
| 3,410,495 | 11/1968 | Eklund | 241/92 X |
| 3,635,410 | 1/1972 | Smith | 144/176 X |
| 3,732,907 | 5/1973 | Nystrom et al. | 144/176 |
| 3,746,062 | 7/1973 | Nystrom et al. | 144/176 |
| 3,756,517 | 9/1973 | Hoch et al. | 241/277 X |
| 3,801,027 | 4/1974 | Kubitz | 241/225 |
| 3,913,643 | 10/1975 | Lambert | 144/163 |
| 4,184,526 | 1/1980 | Hanaya | 144/235 |
| 4,240,588 | 12/1980 | Fighum, Jr. | 144/163 |
| 4,390,132 | 6/1983 | Hutson et al. | 241/92 X |
| 4,444,234 | 4/1984 | Arasmith | 144/370 |
| 4,503,895 | 3/1985 | Arasmith | 144/373 |
| 4,569,380 | 2/1986 | Arasmith | 144/172 |
| 4,610,928 | 9/1986 | Arasmith | 428/402 |
| 4,736,781 | 4/1988 | Morey et al. | 144/176 |
| 4,776,375 | 10/1988 | Arasmith | 144/241 |
| 4,785,860 | 11/1988 | Arasmith | 144/174 |
| 4,802,631 | 2/1989 | Arasmith | 241/88.1 |
| 4,827,989 | 5/1989 | Strong | 144/176 |
| 4,874,024 | 10/1989 | Arasmith | 144/174 |
| 5,054,703 | 10/1991 | Morey | 241/296 |

*Primary Examiner*—W. Donald Bray
*Attorney, Agent, or Firm*—Hopkins & Thomas

[57] ABSTRACT

A disc hog for reducing timbers to wood chips and shards of a predetermined maximum size comprises a housing defining a disc-shaped interior cavity and a heavy metal disc disposed in the cavity and mounted for rapid rotation about its central axis. A feeder opening is formed in the housing and a chute is positioned to facilitate the feeding of timbers through the opening for presentation to the front surface of the rotating disc. Both the front surface and the rear surface of the rotating disc is studded with hammer blocks that protrude outwardly from the surface. The hammer blocks on the front surface are sized and configured to impact, tear apart, and shred a timber fed to the disc into wood chips and shards. The hammer blocks on the rear surface of the disc are sized and configured to reduce wood shards and chips to shards of smaller size. Means are provided for drawing shards from the vicinity of the front surface of the disc and delivering them to the vicinity of the rear surface of the disc for simultaneous processing of shards on each side of the disc to reduce timbers to shards of a predetermined maximum size in a single operation.

33 Claims, 4 Drawing Sheets

DOUBLE ACTION DISC HOG WITH CHIP SIZING GRATE

TECHNICAL FIELD

This invention relates generally to wood and log processing machines and particularly to disk-type wood hogs and chippers for shredding wood into chips and shards of predetermined size.

BACKGROUND OF THE INVENTION

Cylindrical drum-type wood chippers for reducing logs, branches, roots and the like to wood chips are well known. In general, drum type chippers comprise a rotating cylindrical drum having an exterior surface studded either with hammers or sharpened chipper knife blades depending on the desired consistency of the finished chips. Sharpened chipper blades, for example, tend to produce neatly cut wood chips while hammers tend to pulverize, shred, and tear the wood into randomly shaped shards. In use, logs and branches are fed to the rotating drum where the moving hammers or knives reduce them into small pieces that can be transported easily or be used for pulp, mulch, or the like.

Examples of these drum-type wood chippers are found in U.S. Pat. No. 4,802,631 of Arasmith, U.S. Pat. No. 4,785,860 of Arasmith, U.S. Pat. No. 1,418,735 of Plaisted, and U.S. Pat. No. 3,801,027 of Kubitz. In most of these examples, logs to be processed are fed to the surface of the rotating drum by a feeder mechanism such as a conveyor or feed roll. The blades of the drum are configured to impact, cut, and chip the log into pieces of roughly the same size, whereupon the pieces are discharged from the machine through a discharge chute.

In the Arasmith '631 example, a curved foramanous plate extends around the bottom of the rotating drum in spaced relationship therewith. As the wood chips are cut by the knives of the drum, they fall under the influence of gravity onto the foramanous plate. If their size is smaller than the holes in the plate, they fall through the plate and are discharged from the machine. However, if they are too large to pass through the plate, they may be picked up by successive knives as the knives move over the plate and carried back around the drum to be cut and reduced further in size. Alternatively, and preferably, these chips become lodged in the grate openings and are further cut and reduced in size as they are impacted by successive knives. Eventually, all of the chips are reduced to a size sufficiently small to pass through the plate. In this way, the maximum size chip produced by the machine is carefully controlled by the proper sizing of openings in the foramanous plate.

While drum chippers of the type just described have found widespread use in reducing wood to chips, they nevertheless have been plagued with numerous problems and shortcomings inherent in their respective designs. For instance, these types of chippers have traditionally been relatively large and heavy, which tends reduce their portability. Where they have been mounted on large trailers for transportation to a work site, the trailers have tended to be large and heavy, requiring a substantial and expensive towing vehicle. Further, these drum-type chippers have tended to be rather inefficient and have required large gas or diesel powered engines for their operation.

The inefficiency of drum chippers is heightened by the constraint that only the exterior surface of the rotating drum is usable since their interior surfaces are enclosed within the drum itself. Also, centrifugal force acting on the resulting chips in drum chippers naturally tends to propel the chips radially away from the drum surface. Thus, baffles and the like are required to constrain the chips to the vicinity of the chipper knives if any secondary cutting of the chips is to take place. Even with baffles, secondary cutting has not proven to be easily achievable with drum chippers. In fact, in some instances two drum chippers with different size knives have been used in succession to reduce wood to chips of a desired small size. Finally, the chipper blades on the surface of a drum chipper necessarily all move at the same velocity. However, it is well known that faster moving knives result in smaller chips than slower moving blades. Thus, reaping the advantages of different speed knives simply is not possible in the same operation with a drum-type chipper.

Disc chippers have been developed to address some of the problems associated with drum-type chippers. These disc chippers employ a rotating knife bearing disc rather than a cylindrical drum to reduce wood to chips. A good example of a disc chipper is presented in U.S. Pat. No. 4,827,989 of Strong. Other examples are illustrated in U.S. Pat. No. 1,195,774 of Brown, U.S. Pat. No. 3,732,907 of Nystrom, and U.S. Pat. No. 4,736,781 of Morey et al. In general, these devices comprise a housing that carries a rapidly spinning metal disc having knives mounted on one surface of the disc just behind gullets that pass through the disc. Logs to be processed are fed to the disc surface, usually at an angle, where the knives reduce the wood to chips. The chips, when cut, pass through the gullets in the disc. In this way, the chips move to the back side of the disc where they can be discharged from the machine. To the best of applicant's personal knowledge, all commercial prior art disc chippers include such knife and gullet arrangements.

While prior art disc chippers have been improvements over drum chippers for certain applications, they nevertheless have had their own set of problems and shortcomings. For instance, in some cases these chippers have not been able to provide accurate control of chip size since each chip is only cut once before it passes through a gullet in the disc and is discharged from the machine. This can be a particular problem when the cutters become dull. Also, as with drum chippers, there has been a natural lower limit to the size chip that could be produced in a single operation with prior art disc chippers and, in some cases, multiple operations have been required to reduce logs to chips of a desired small size. Finally, as can be seen from the above patent examples, complex knife designs have been invented to improve the efficiency or control the chip sizes in disc chippers. However, these high-tech knives are expensive to manufacture, require frequent sharpening or replacement, and can be utterly destroyed when encountering a stray rock or piece of metal that may be entangled or embedded in wood being processed.

Thus, there exists a continuing and heretofore unaddressed need for a disc-type wood hog that is efficient, economical, reliable, and that can reduce wood to chips or shards of virtually any desired small size in one single operation. Such a disc hog should do this without the need for expensive, high maintenance chipper knives and should provide for easy maintenance when necessary. It is to the provision of such a disc hog that the present invention is primarily directed.

SUMMARY OF THE INVENTION

Briefly described, the present invention, in one preferred embodiment thereof, comprises an improved disc hog for reducing logs, branches, and timbers to wood chips and shards of a predetermined maximum size. The disc hog comprises a heavy rotating metal disc having a front surface and a rear surface and being housed within a substantially cylindrical metal casing. The disc is solid and is formed without gullets or other openings passing therethrough. The casing is formed with a substantially disc shaped front wall that is disposed in spaced relationship to the front surface of the rotating disc and a substantially disc shaped rear wall that is disposed is spaced relationship to the rear surface of the disc. The front and rear walls of the casing are joined about their peripheries with a curved side wall to close the casing about the rotating disc.

The front surface of the rotating disc is studded with an array of knives or hammers that protrude outwardly from the disc a predetermined distance. In operation, the hammers impact a timber presented to the disc to tear and shred the timber into small irregular shards. Preferably, but not necessarily, the hammers are arranged in a spiral pattern on the disc, spiraling inwardly or outwardly from the hub of the disc toward its periphery.

A material feeder opening is formed in the front surface of the casing at a predetermined radial distance from the center of the rotating disc. The feeder opening is provided with a guide chute to direct timbers through the opening and present them to the front surface of the rotating disc for processing. The guide chute is angled with respect to the surface of the rotating disc in such a way that when a timber engages the hammers on the rotating disc, the hammers tend to pull the timber into the disc as they shred the timber into shards. This provides automatic feeding of material into the machine.

A hardened metal anvil is positioned at the bottom of the feeder opening and extends inwardly toward the surface of the rotating disc. The anvil, which can be aligned along a radius of the disc or can be skewed with respect to such a radius, is formed with notches through which and between which the hammers of the disc pass as they move past the feeder opening. In use, the end of a timber presented to the disc rests on the anvil to provide a solid support surface for the timber as the hammers cut and tear through the timber.

A foramanous plate having a multitude of openings or holes formed therethrough is positioned between the front surface of the disc and the front surface of the casing. The foramanous plate forms a grate and its openings are sized to pass wood chips and shards having sizes smaller than the diameters of the openings. The grate is also formed with a feeder opening aligned with the opening in the casing so that wood can be fed through the casing and through the grate to be presented to the rotating disc.

In use, when a timber is presented to the rotating disc through the feeder openings, it is shredded and torn by the moving hammers into small pieces. Pieces small enough to pass through the openings in the grate do so and are expelled from the machine. However, wood shards that are larger than the openings remain in the space between the rotating disc and the grate where they are repeatedly impacted by the hammers until reduced to shards small enough to pass through the openings. Thus, only wood shards of a predetermined maximum size are produced.

In one enhanced embodiment of the invention, both the front and rear surface of the rotating disc are studded with hammers and a foramanous plate is positioned adjacent to and spaced from the rear surface as well as the front surface of the disc. In this embodiment, the casing has a oblate section at its top and the periphery of the disc is provided with transversely exiting fins. The fins are angled to function as a fan that directs air and wood shards from the vicinity of the front surface of the disc, through the oblate section of the casing, and to the vicinity of the rear surface of the disc as the disc rotates. Further, hammers on the front side of the disc may be of a size and shape suitable for primary breakdown of a timber while the rear hammers may be of a different size, shape, and quantity for efficient further processing to a finer finished size. With this embodiment, timbers fed through the feed opening are roughly shredded by hammers on the front of the disc. The resulting shards are then drawn through the oblate section of the casing and presented to the rear side of the disc, where they are further reduced until small enough to pass through the openings of the foramanous plate. This dual action disc hog provides reduction of timbers to virtually any size shards and chips, including an almost sawdust consistency, in a single operation with a single machine. Of course, gullets may be employed to move shards to the back side of the disc if desired.

Thus, an improved disc hog is now provided that reliably produces wood shards of only a predetermined maximum size. In addition, since both sides of the disc are used simultaneously to reduce the wood, complete reduction from timber to shards of virtually any desired small size can be produced in a single operation. Also, the disc hog of this invention can be compact and portable relative to larger drum type chippers and is economical to produce and operate. Since simple hammers are used to reduce the wood to shards, no complex and expensive knives are required and the associated necessity of frequent sharpening is completely eliminated. These and other objects, features, and advantages of the present invention will become more apparent upon review of the detail description set forth below taken in conjunction with the accompanying drawings, which are briefly describes as follows.

DETAILED DESCRIPTION OF THE PREFERRED EMBODIMENT

Figure 1A:
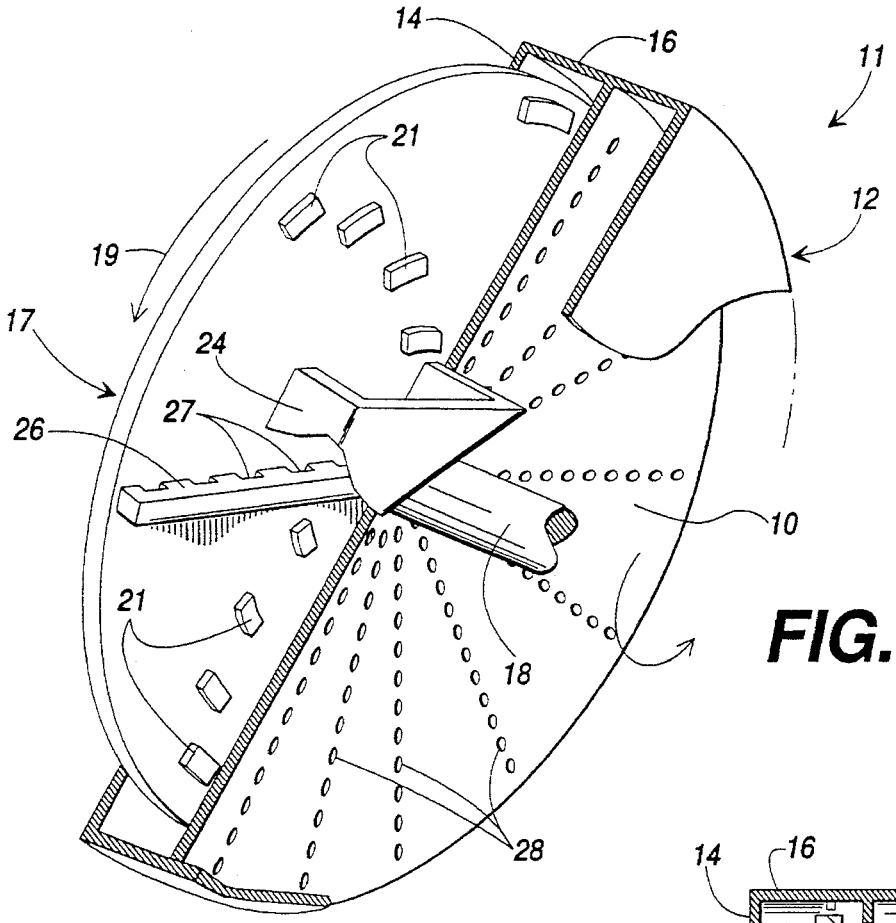
FIG. 1A is a perspective partially sectioned view of a disc hog that embodies principals of the present invention in one preferred form.
Figure 1B:
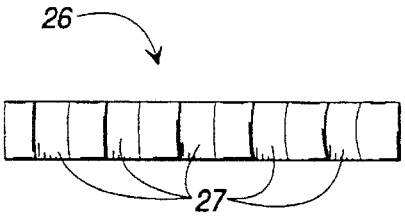
FIG. 1B illustrates the bottom surface of an anvil adapted to be disposed along a radius of the rotating disc of the present invention.
Figure 1C:
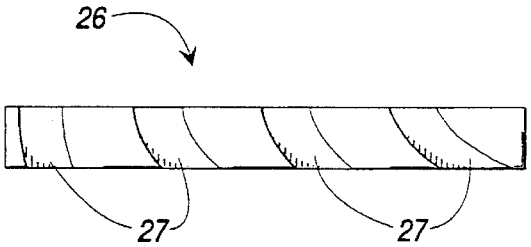
FIG. 1C illustrates the bottom surface of an anvil adapted to be disposed in skewed relationship to a radius of the rotating disc.

Referring now in more detail to the drawings, in which like numerals refer to like parts throughout the several views, FIGS. 1A–1C illustrate principals of the present invention in a preferred embodiment. In these Figures, much of the casing as well as the support frame and trailer have been eliminated for clarity and for illustration of the unique features of the invention. U.S. Pat. No. 4,827,989 of Strong illustrates a trailer and support frame arrangement that could function well with the present invention.

As illustrated in FIGS. 1A–1C, the disc hog 11 of this invention comprises a heavy metal housing 12, which is shown in section with portions cut away in FIG. 1A. The housing 12 is formed to have a substantially circular front wall 13 and a corresponding circular rear wall 14 spaced from the front wall 13. The front and rear walls are joined together by a curved ring-shaped side-wall 16 that extends around the periphery of the front and rear walls. With this configuration, the housing 12 defines a thin cylindrical or disc shaped interior cavity of the housing.

A heavy metal disc 17 is disposed within the cavity of the housing 12 as best seen in FIG. 1A. The disc 17 is mounted at its center on a drive shaft 18, which can be driven to rotate the disc 17 rapidly in the direction indicated by arrow 19. It can thus be seen that the disc 17 is mounted for rotation about its central axis within the interior cavity of the housing 12.

Figure 2:
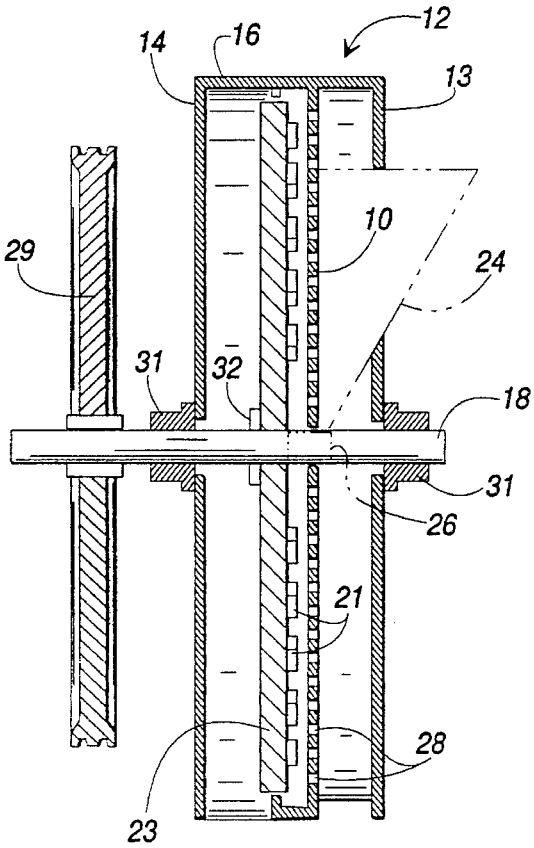
FIG. 2 is a sectional side view of the invention showing the hammer studded disc and the casing with a foramanous grate for sizing the finished shards of wood.

The disc 17 has a front surface 22 and a rear surface 23 (FIG. 2). A plurality of hammer blocks 21 are mounted to the front surface 22 of the disc 17 and protrude outwardly therefrom as shown. In the embodiment of FIG. 1A, the hammer blocks 21 are arrayed on the surface of the disc in spiraling patterns from the center of the disc toward its periphery. However, while a spiral patterned array has been found to be advantageous in this invention, other configurations of the hammer blocks 21, such as, for example, radial and circular arrays, might be used with comparable results. Thus, the spiral array of the hammer blocks in the preferred embodiment should not be considered to be a limitation of the invention but only exemplary of a preferred arrangement of the blocks.

The front surface 13 of the housing 12 is formed with a feeder opening that provides access through the housing to the front surface 22 of the disc 17. A chute 24 is fixed to the front surface of the housing covering the feeder opening and is angled with respect to the housing to present work product through the feeder opening and to the disc 17 at an appropriate angle as discussed in more detail below. An anvil 26, which preferably is made from a hardened steel material for durability, is fixed to the front surface 13 of the housing 12 at the bottom of the feeder opening formed therein and at the bottom of the chute 24. The anvil 26 forms a solid secure surface against which the ends of logs and timbers rest as they are torn and shredded into wood shards by the moving hammer blocks 21. While the feeder opening formed in the front surface 13 of the housing 12 is not visible in FIG. 1A because the housing's front surface is shown in cut-away section, it will be understood that such feeder opening is formed beneath the chute 24 and that the chute and the anvil 26 are securely fixed to the housing at the location of the feeder opening.

The anvil 26 is generally elongated in shape and extends in width toward the front surface 22 of the disc 17. An array of slots 27 are formed in the anvil 26 and are sized and positioned such that some of the hammer blocks 21 pass through the slots 27 and some pass between the slots and under the anvil as the blocks move past the feeder opening formed in the housing 12. In this way, the anvil not only provides a firm support for the end of a timber that is being shredded, but also assures efficient operation of the hammers as a result of the scissor-like action that occurs when the hammers pass through and between the slots 27.

The anvil in FIG. 1A is shown to be oriented in a generally radially aligned orientation with respect to the disc 17. However, the anvil could just as well be oriented in a skewed relationship to a disc radius for even more efficient processing of timbers by the disc hog. FIGS. 1B and 1C illustrate the formation of slots in radially aligned and skewed anvils respectively. In a radially aligned anvil (FIG. 1B), the slots 27 are seen to be formed substantially transversely across the width of the anvil 26. With this configuration, it will be understood that all of the hammer blocks 21 intersect the anvil 26 at substantially right angles. As a consequence, they pass through and between the slots 27 at substantially right angles to the anvil. The result is that the same character tearing and shredding of the wood occurs all along the length of the anvil 26.

With a skewed anvil (FIG. 1C), however, it can be seen that the hammers near the center of the disc 17 intersect the anvil at acute angles while the hammers at the outside of the disc intersect the anvil at less acute almost transverse angles. Such a configuration increases the efficiency of hammer cutting action since the interior hammers experience more of a scissor action when passing through the anvil than the exterior hammers. In addition, the interior hammers, which move more slowly but with greater force, efficiently rip and tear timbers introduced through the feeder opening while the exterior hammers, which move much faster but with less force, efficiently reduce larger wood shards produced by the inner-hammers to smaller sizes. This process is facilitated since centrifugal force naturally tends to propel shards from the inner regions of the disc toward the outer regions thereof.

A disc-shaped foramanous plate 10 is disposed within the housing 12 and is positioned between the front wall of the housing and the disc 17. The plate 10 is formed with a plurality of openings 28 through which wood shards and chips can pass. A feeder opening (not shown) is formed through the plate 10 and is aligned with the feeder opening in the front wall 13 of the housing 12 and with the chute 24. Thus, material to be processed is fed through the casing and through the plate to the surface of the rotating disc. The openings 28 are arranged in radially extending patterns in FIG. 1A; however, various other patterns might function just as well. The openings 28 and plate 10 together form a grate through which wood chips and shards can pass when they are reduced to a size at most equal to the diameter of the openings 28. Thus, as logs and timbers are smashed and torn into shards by the moving hammer blocks 21, the shards remain in the space between the disc and the grate until they are further reduced to a size sufficiently small to pass through the openings 28. In this way, the disc hog of the present invention insures the production of wood chips and shards having a maximum size that is predetermined by the size of the openings 28.

FIG. 2 is a side view, partially in section, showing the elements of the present invention from a different perspective. The drive shaft 18 is seen to be mounted within appropriate bearings 31 that, in turn, are fixed to the housing 12 as shown. The disc 23 is appropriately fixed to the drive shaft 18 by means of a mounting collar 32 or any other appropriate means for securing the disc firmly to the shaft. A sheave 29 is secured to the shaft 18 on the back side of the housing 12. The sheave 29 is formed to accept a drive belt that, in turn, is coupled to the sheave of a drive motor (not shown). Thus, the sheave 29 and consequently shaft 18 and disc 23 are rotated rapidly upon actuation of the drive motor.

The chute 24 and anvil 26 are shown in phantom lines in FIG. 2 for clarity. It can be seen from this Figure, however, that the anvil 26 extends toward the surface of the disc 23 and that it is located at the bottom of the feeder opening formed through the front wall 13 of the housing 12. Hammer blocks 21 are seen to be arrayed on the surface of the disc 23. The grate 10 is seen to be positioned adjacent the front surface of the disc 17.

In use, the disc hog of FIG. 2 can be oriented vertically as shown, whereupon branches and debris can be fed at a substantially vertical angle through the chute 24 for processing by the hammer blocks 28. For processing logs, timbers, and heavier pieces of wood, the apparatus can be tilted at an angle so that timbers are fed horizontally through the chute 24 for presentation to the disc 23. In either case, material to be processed is presented to the disc and to the hammer blocks 21 at a skewed angle and in the general direction of disc rotation. Accordingly, the hammer blocks 21 not only impact, tear, and shred the timbers into shards, they also tend to pull the timbers into the disc as it is processed. This eliminates the need for expensive and complicated feed and press mechanisms that are common in prior art devices.

Figure 3:
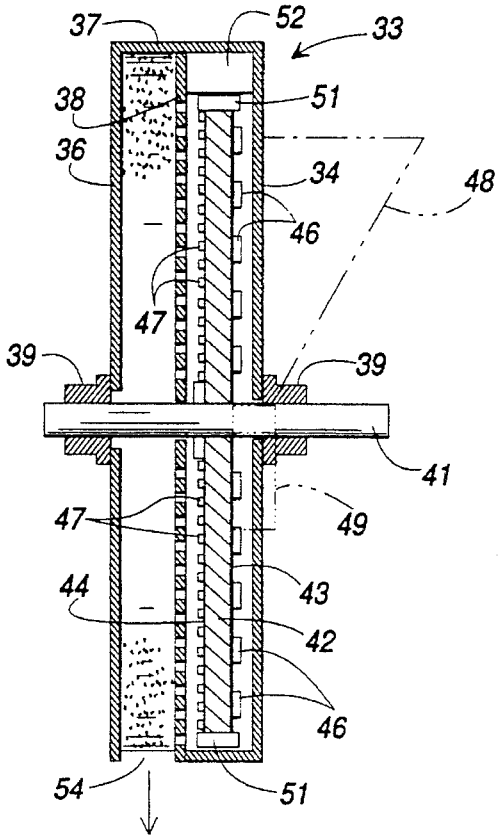
FIG. 3 illustrates an alternate embodiment of the invention wherein both sides of the rotating disc are studded with hammers and processing occurs on both sides simultaneously.
Figure 4:
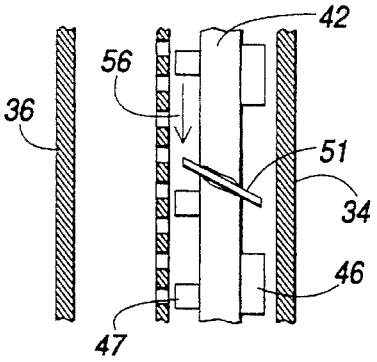
FIG. 4 is a partial cutaway view from the side of the embodiment of FIG. 3 showing the fins that act as a fan to draw shards from the front side of the disc to the back side thereof.
Figure 5:
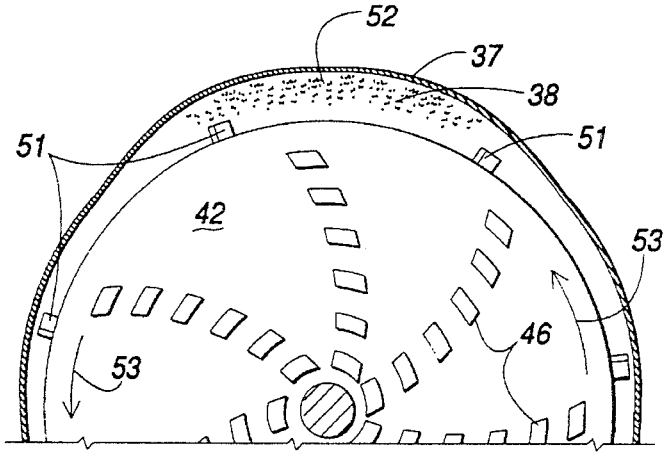
FIG. 5 illustrates the oblate top section of the casing through which shards are directed in the embodiment of FIG. 3.

FIGS. 3–5 illustrate another embodiment of the invention wherein wood shards are processed on both sides of the rotating disc simultaneously. This embodiment comprises a housing 33 having a front wall 34 and a rear wall 36 joined together by a ring-shaped side wall 37. A foramanous plate or grate 38 is disposed between the front and rear walls of the housing 33 and divides the interior portion of the housing into a forward cavity and a rear cavity.

Bearing blocks 39 are mounted to the housing 33 at its center and a drive shaft 41 is rotatably secured within the bearings as shown. A heavy metal disc 42 is fixed to the drive shaft 41 and is disposed within the front cavity of the housing 33. With this configuration, it can be seen that when the drive shaft 41 is rotated by a motor (not shown), the disc 42 is caused to rotate or spin rapidly within the forward chamber of the housing 33.

The disc 42 has a front surface 43 adjacent to and spaced from the front wall 34 of the housing and a rear surface 44 adjacent to and spaced from the grate 38. The front surface 43 of the disc 42 is studded with an array of hammer blocks 46 that are firmly fixed to the disc and extend outwardly therefrom. Preferably, the hammer blocks 46, as in the first embodiment, are arrayed in a spiral configuration, although other configurations of the hammer blocks might function as well.

The rear surface 44 of the disc 42 is also studded with an array of hammer blocks 47 that are fixed to the surface of the disc and extend outwardly therefrom. The rear hammer blocks 47 preferably have a different size than the front hammer blocks 46 and, in the preferred embodiment, are smaller than the front hammer blocks. They may also have different configurations and be arrayed differently than the front blocks. As with the previous embodiment, this embodiment includes a sloped chute 48, that directs material at an angle through an access opening formed in the front wall 34 of the housing 33. Also as in the first embodiment, a hardened metal anvil 49 is fixed to the front wall 34 of the housing at the bottom of the access opening and extends inwardly toward the surface of the disc 42. In FIG. 3, the chute 48 and anvil 49 are shown in phantom lines for clarity. However, it can be seen that in this embodiment, the anvil 49 is not aligned along a radius of the disc but instead is oriented in a skewed relationship with respect to such radius. Thus, the anvil 49 in this embodiment corresponds to the anvil in FIG. 1C in its general shape and configuration. As discussed above, a skewed anvil provides more efficient reduction of timbers into shards at the center of the disc and efficient reduction of these shards to smaller sizes at the peripheral portions of the disc.

A set of fins 51 are welded or otherwise fixed around the periphery of the disc 42 as illustrated in all of FIGS. 3–5. The fins 51 are substantially longer than the thickness of the disc 42 and, as best seen in FIG. 4, are oriented at an angle with respect to the surfaces of the disc. The housing 33 is shaped to define a bulge or oblate section 52 at its top portion. The fins 51 are sized to move as the disc rotates in closely spaced relationship to the side wall 37 of the housing except in the oblate section 52 thereof, where there is substantial space between the fins and the side wall (FIG. 5). Accordingly, it can be seen that the oblate section of the housing 52 forms a passageway that communicates between the vicinity of the front side 43 of the disc 42 and the vicinity of the rear side 44 of the disc.

As the disc 42 is rotated in the direction of arrows 53, the fins 51 move rapidly around the exterior of the housing. Since they are angled with respect to the surface of the disc, the moving fins function as a fan that creates a draft through the feeder opening in the front wall 34 of the housing, up and through the oblate section 52 of the housing, into the region between the rear surface 44 of the disc, and through the openings in the grate 38. Thus, when timbers and other materials are fed to the front surface of the disc through the chute 48, they are first reduced to shards of one size by the moving hammer blocks 46 on the front surface of the disc. These shards are then thrown by centrifugal force to the region of the periphery of the disc, where the draft created by the fins 51, in conjunction with the physical impact of the blades on the shards, tends to draw the shards from the vicinity of the front of the disc, through the oblate section 52, and to the vicinity of the rear side of the disc.

Once on the rear side of the disc, the shards are reduced further in size by the smaller hammer blocks 47 until they are small enough to pass through the openings in the grate 38. Thus, in a single operation, a timber or other material is reduced to shards of one size on the front of the disc, whereupon the shards are transferred to the rear of the disc and reduced further to a maximum size determined by the diameter of the openings in the grate. Accordingly, with this embodiment of the invention, processing of material takes place simultaneously both on the front and rear surfaces of the disc thus eliminating the need for separate operations as has sometimes been the case in the past. Therefore, the double-action of this disc hog in conjunction with the sizing grate allows large timbers to be reduced to wood chips and shards of a very small size in one single operation and with a single machine.

A discharge opening 54 is formed in the bottom of the side wall 37 behind the grate 38 as shown in FIG. 3. The final wood shards and chips that pass through the grate into the space between the grate and the rear wall 36 of the housing simply fall downwardly and through the discharge opening 54, where they can be collected in a traditional manner.

Figure 6A:
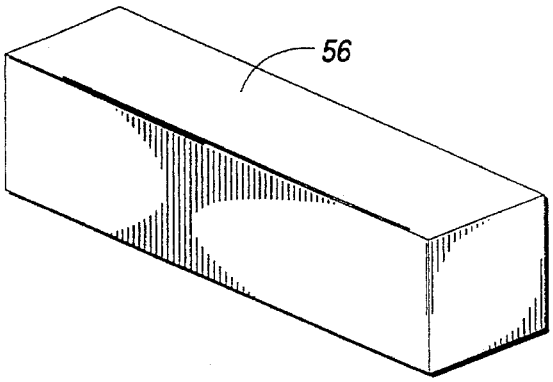
FIGS. 6A–7B illustrate various embodiments of hammers for use with the disc hog of this invention.

FIGS. 6A–7B illustrate various designs of hammer blocks for use with the present invention. FIG. 6A shows a hammer block 56 in the form of a simple substantially rectangularly shaped metal block. Preferably, the block 56 is shaped to have a slightly curved profile so that it passes in closely spaced relationship with the walls of the notches within the anvil. This ensures more efficient operation of the device in reducing timbers to shards.

Figure 6B:
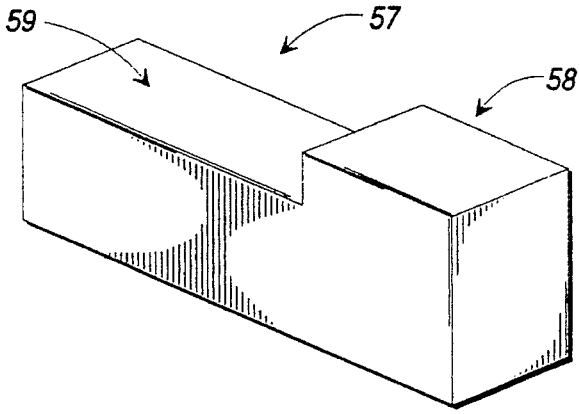

FIG. 6B shows another embodiment of a hammer block for use with the present invention. Hammer block 57 is formed to have a raised front section 58 and a relatively lowered rear section 59. This provides ample contact between the hammer block and the surface of the disc for secure fastening while also providing an impact surface of sufficient size to tear and shred timbers being treated in the machine.

Figure 6C:
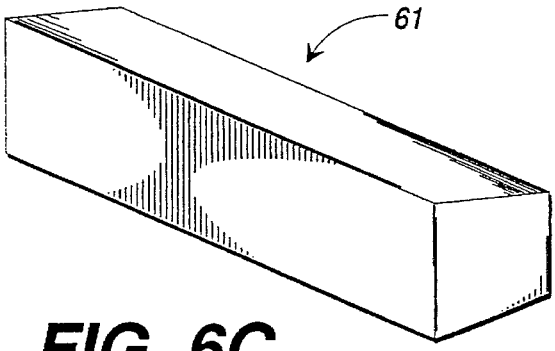

FIG. 6C shows a hammer block 61 having a generally trapezoidal cross-section, being thinner on its far side than on its near side. This hammer block is configured for use with an embodiment of the invention that incorporates a slightly cone-shaped grate. This embodiment is discussed in more detail below. Generally, however, the grate is spaced further from the disc at its center than at its periphery. The trapezoidal shaped hammers conform to the cone-shaped grate.

Figure 7A:
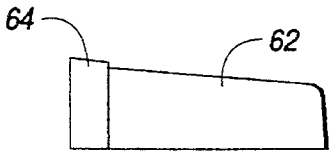
Figure 7B:
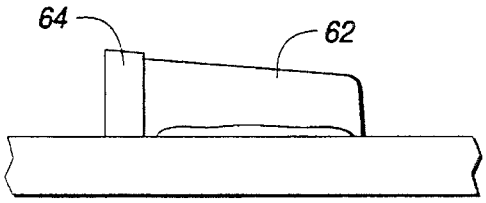

FIGS. 7A and 7B illustrate still anther embodiment of a hammer block for use with the present invention. In this embodiment, a mounting bracket 62 is welded or otherwise secured to the surface of the disc 63. A hardened impact blade 64 is mounted to the front of the mounting bracket 62 by means of a screw or other appropriate fastener. The impact blade 64 preferably is formed of a hardened carbon steel material that can be replaced easily when dulled. Further, it can be seen that the mounting bracket 62 is tapered and curved such that the impact blade 64 can pass with close tolerance through the slots formed in the anvil without the trailing part of the impact blade or the mounting bracket interfering with such passage.

Any of the just described hammer block configurations are contemplated by the present invention as well as hammer blocks of other non-illustrated configurations. Thus, the present invention should not be deemed limited by the illustrated hammer block configurations of FIGS. 6 and 7 since any appropriate hammer block or knife configuration is contemplated to be within the scope of the present invention. The term "hammer" when used herein and in the claims is intended to encompass any and all of such hammer or knife configurations. It will be understood by those of skill in this art that it is desirable to have hammers that pass through the slots in the anvil as well as shorter hammers that pass under the anvil and between the slots. In this way, at least one hammer is positioned at all radial positions on the disc. The hammers may also overlap radially to provide even more certain coverage. Such an arrangement insures that wood is shred evenly, helps prevent clogs, and results in the most efficient machine operation.

Figure 8:
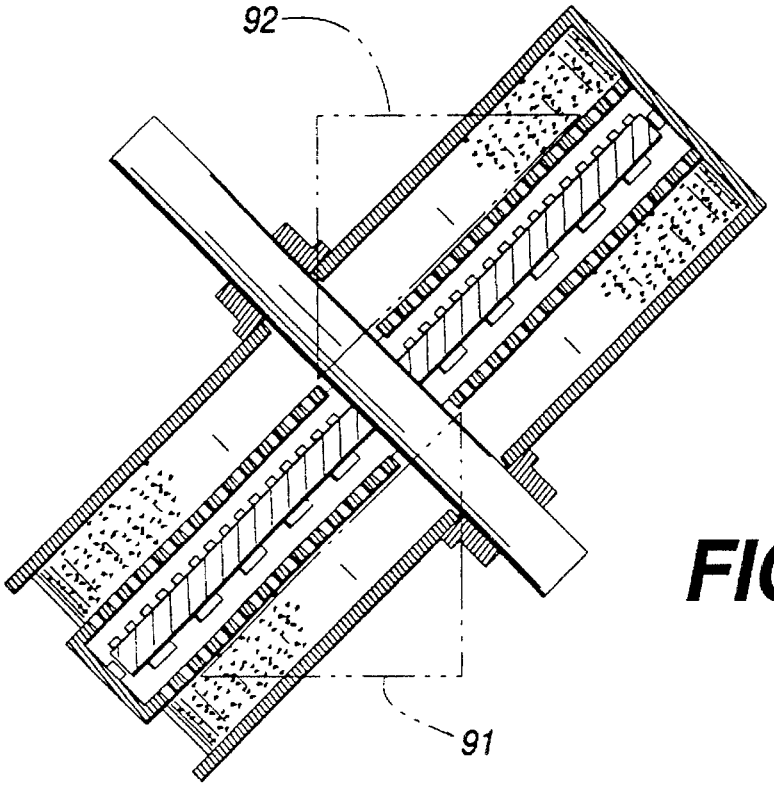
FIG. 8 illustrates a further embodiment of the invention wherein each side of the disc is used independently for processing material of different sizes.

FIG. 8 illustrates a still further embodiment of the invention wherein the front and rear surfaces of the rotating disc can be used independently and simultaneously to process material of different sizes. In this embodiment, the sides of the disc are isolated, the machine is tilted, and each side is studded with hammers and provided with a grate. A first chute 91 is fixed to one side of the housing and is oriented to receive long or large timbers horizontally and present them to the disc for processing in the same way as with previously described embodiments. A second chute 92 is mounted to the other side of the housing and oriented to receive small and short pieces of wood, such as branches, vertically and present them to the other side of the disc for processing. Hammers on the front and back sides of the disc as well as the grate openings are appropriately sized to process the large and small material respectively. Thus, this embodiment is versatile in that large and small material can be processed simultaneously.

Figure 9:
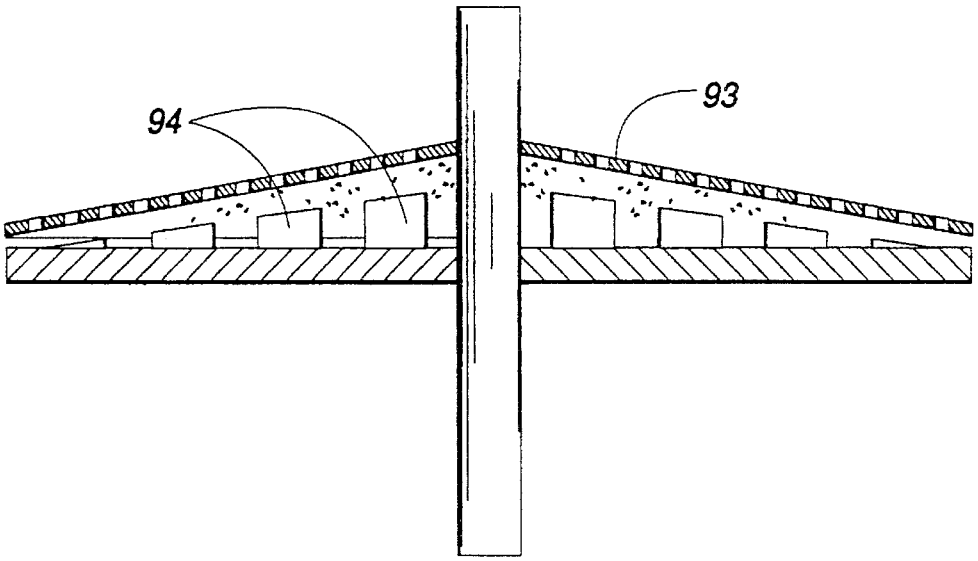
FIG. 9 illustrates a still further embodiment wherein the grate is cone-shaped and the hammers are successively smaller with increasing radius from the center of the disc.

FIG. 9 illustrates an alternate embodiment wherein the grate 93 is slightly conical in shape, being spaced further from the disc at its center than at its periphery. The trapezoidal shaped hammers 94 of FIG. 6C are used with this embodiment to conform to the decreasing distance between the grate and the disc with increasing radius. The hammers can also be formed to be small and thus cut finer at the periphery than at the center. With this embodiment, efficiency at processing larger material is increased at the center of the disc while efficiency at processing smaller material is increased at the periphery of the disc.

The invention has been described herein in terms of preferred embodiments and methodologies. It will be obvious to those of skill in this art, however, that various modifications might well be made to the illustrated embodiments within the scope of the invention. For example, the anvils in the present invention have been illustrated with slots through which the hammer blocks pass. It is within the scope of the invention that hammer blocks of differing heights might be used on a single surface of a disc with some of the hammer blocks passing through the slots and some passing beneath the anvil in the space within the slots. In addition, anvils might very well be employed on both sides of the disc in the embodiment of FIG. 3 to enhance the reduction of wood to small shards. Also, while an oblate section of the housing and fan blades are illustrated as a means for transferring shards from one side of the disc to the other, it should be understood that any appropriate method for accomplishing such a transfer is within the scope of the invention. This might, for example, include a separate vacuum system or even gullets in the disc through which the shards pass.

Finally, the overall configuration of the housing and means for mounting the various components of the invention, while preferred, should not be deemed to be a limiting feature of the invention. These and other additions, deletions, and modifications might well be made to the illustrated embodiments without departing from the spirit and scope of the invention as set forth in the claims.

I claim:

1. An apparatus for reducing wood to chips and shards of a predetermined maximum size, said apparatus comprising:

a housing having a front wall formed with a feeder opening through which timbers can be introduced into said housing;

a disc mounted for rotation about its central axis and being disposed in said housing;

said disc having a front surface and a rear surface with said front surface being disposed in spaced relationship with said front wall of said housing;

said feeder opening being located on said front wall of said housing to present timbers said front surface of said disc as said disc rotates within said housing;

hammer means on said front surface of said disc for reducing timbers presented to the disc into wood chips and shards;

grate means on said apparatus for confining the wood chips and shards to the vicinity of said hammer means on said rotating disc to aid in further reduction of the chips and shards to a predetermined maximum size; and means for expelling the wood chips from the housing when they have been reduced to the predetermined maximum size.

2. The apparatus of claim 1 and further comprising a chute fixed to said housing adjacent to said feeder opening to direct timbers through said opening at a predetermined angle relative to said front surface of said rotating disc.

3. The apparatus of claim 2 and wherein said predetermined angle is selected to present timbers to the rotating disc generally in the direction of rotation of the disc whereby said hammer means grips the timber and tends to pull it into the rotating disc as the timber is reduced by the hammer means into chips and shards.

4. The apparatus of claim 3 and further comprising an elongated hardened anvil fixed to said housing at the bottom of said feeder opening and extending toward said front surface of said rotating disc, said anvil being configured to provide a solid firmly fixed surface against which the end of a timber rests as the timber is shredded and torn into chips and shards by said hammer means.

5. The apparatus of claim 4 and wherein said anvil is disposed substantially along a radius of said rotating disc.

6. The apparatus of claim 4 and wherein said anvil is oriented in skewed relationship with respect to a radius of said rotating disc.

7. The apparatus of claim 1 and wherein said hammer means comprises an plurality of hammer blocks protruding outwardly from the surface of said disc.

8. The apparatus of claim 7 and wherein said plurality of hammer blocks are arranged in spiral arrays from the axis of said rotating disc toward the periphery thereof.

9. The apparatus of claim 7 and further comprising a hardened anvil fixed to said housing at the bottom of said feeder opening, said anvil extending from said feeder opening toward said front surface of said rotating disc and being formed with an array of notches through which some of said hammer blocks pass as they move past said feeder opening, whereby a timber presented to the rotating disc through the feeder opening is supported on the anvil and the anvil notches in cooperation with the moving hammer blocks provides for efficient shredding of the timber into chips and shards.

10. The apparatus of claim 9 and wherein said anvil is generally elongated in shape and is oriented substantially along a radius of said rotating disc, said notches extending substantially transversely through said anvil, whereby the moving hammer blocks intersect the anvil at substantially right angles.

11. The apparatus of claim 9 and wherein said anvil is generally elongated in shape and is oriented in skewed relationship with respect to a radius of said rotating disc, said notches having different shapes and orientations relative to said anvil depending upon their position along the length of the anvil, whereby each of the moving hammer blocks intersects the anvil at a different angle depending the radial distance of the hammer block from the axis of the rotating disc.

12. The apparatus of claim 1 and wherein said housing has a rear wall disposed in spaced relationship with said rear surface of said disc, said apparatus further comprising hammer means on said rear surface of said disc for reducing wood shards to smaller sizes and means for transferring shards from the vicinity of said front surface of said disc to the vicinity of the rear surface of said disc, whereby timbers are reduced to shards of a first size by the hammer means on the front surface of the disc whereupon the shards are transferred to the vicinity of the rear surface of the disc where they are reduced to a smaller size before being expelled from the apparatus.

13. The apparatus of claim 12 and further comprising grate means positioned adjacent to said rear surface of said disc to confine shards to the vicinity of said rear surface for repeated reduction by said hammer means until the shards are reduced to a size sufficiently small to pass through said grate means and be expelled from said apparatus.

14. The apparatus of claim 13 and wherein said grate means comprises a foramanous plate fixed to said housing and disposed in spaced substantially parallel relationship to said rear surface of said disc.

15. The apparatus of claim 12 and wherein said hammer means on said front surface of said disc comprises a plurality of hammer blocks protruding outwardly from said front surface and arrayed to impact, shred, and tear apart timbers that are presented to said disc for processing.

16. The apparatus of claim 15 and wherein said hammer means on said rear side of said disc comprises a plurality of hammer blocks protruding outwardly from said rear surface and arrayed to impact and reduce the size of wood shards to shards of smaller sizes.

17. The apparatus of claim 16 and further comprising an elongated hardened anvil fixed to said housing at the bottom of said feeder opening with said anvil extending along its width toward said front surface of said disc, said anvil being formed with slots positioned such that at least some of said hammer blocks pass through said slots as they move past said feeder opening, whereby timbers fed to said rotating disc rest upon said anvil for support and said slots in conjunction with said hammer blocks provide efficient reduction of the timber into shards.

18. The apparatus of claim 17 and wherein said anvil is substantially radially aligned with said disc and wherein said slots are formed substantially transversely through said anvil.

19. The apparatus of claim 17 and wherein said anvil is aligned in skewed relationship with respect to a radius of said disc and wherein said slots are formed at differing angles across said anvil depending upon the distance of the slot from the axis of said disc.

20. The apparatus of claim 12 and wherein said means for transferring shards from the vicinity of said front surface of said disc to the vicinity of the rear surface comprises a set of fins secured to the periphery of said disc with said fins being oriented to draw shards from the vicinity of said front surface of said disc and deliver them to the vicinity of said rear surface of said disc as the disc rotates.

21. The apparatus of claim 20 and wherein said housing includes a substantially circular band shaped side wall that joins said front wall to said rear wall with said side wall being formed with a radially outwardly bulging oblate section at a selected peripheral location on said housing, said blades being sized and positioned to pass closely adjacent to said side wall except in the region of said selected peripheral location, whereby the blades act as a fan causing wood shards in the vicinity of the front surface of the disc to be drawn through the oblate section of the housing and to the vicinity of the rear surface of the disc where the shards are further reduced in size by the hammer means thereon.

22. The apparatus of claim 1 and wherein said grate means comprises a foramanous plate positioned between said front wall of said housing and said front surface of said disc and being spaced from said front surface of said disc, said foramanous plate being formed with a plurality of openings sized to pass wood chips of a predetermined maximum size.

23. A disc hog for reducing timbers to wood shards of a predetermined maximum size, said disc hog comprising:

a housing having a front wall and a rear wall joined by a substantially circular ring shaped side wall to form a substantially disc shaped interior cavity of said housing;

a disc having a front surface and a rear surface and being disposed in said interior cavity of said housing, said disc being mounted on a drive shaft for rotation of said disc about its central axis;

said front wall of said housing being disposed in spaced substantially parallel relationship to said front surface of said disc and said rear wall of said housing being disposed in spaced substantially parallel relationship to said rear surface of said disc;

means for driving said shaft to cause said disc to rotate within said interior cavity of said housing;

a feeder opening formed is said front wall of said housing through which timbers can be introduced into said housing and presented to the front surface of said rotating disc;

a first plurality of first pulverizing means protruding outwardly from said front surface of said disc with said first pulverizing means being arrayed to impact a timber fed through said feeder opening, said first pulverizing means being configured to cut, shred, or tear the timber into wood chips and shards;

a plurality of second pulverizing means protruding outwardly from said rear surface of said disc with said second pulverizing means being arrayed to impact wood shards in their vicinity and reduce the shards to chips and shards of a smaller size;

means for transferring wood shards from the vicinity of said front surface of said disc to the vicinity of said rear surface of said disc for further processing; and means for expelling wood shards from the vicinity of said rear surface of said disc when the shards are reduced to a predetermined maximum size.

24. The disc hog of claim 23 and wherein said means for transferring wood shards from the vicinity of said front surface of said disc to the vicinity of said rear surface of said disc comprises fan means on said wood hog for drawing the shards from the vicinity of said front surface and delivering them to the vicinity of said rear surface.

25. The disc hog of claim 24 and wherein said fan means comprises a set of fins arrayed about the periphery of said disc and a passageway defined in said interior cavity of said housing with said passageway communicating between the vicinity of the front surface of said disc and the vicinity of the rear surface of said disc, said fins being shaped and oriented to draw shards from the vicinity of said front surface of said disc and deliver them through said passageway to the vicinity of said rear surface of said disc.

26. The disc hog of claim 25 and wherein said passageway is formed by an outwardly bulging oblate section of said ring shaped side wall.

27. The disc hog of claim 23 and further comprising an anvil mounted to said front wall of said housing on one side of said feeder opening, said anvil extending toward the front surface of said disc to provide firm support for the end of a timber being fed to said disc.

28. The disc hog of claim 27 and wherein said anvil is formed with slots through which at least some of said hammer blocks pass as they move past said anvil on said rotating disc.

29. The disc hog of claim 28 and wherein said anvil is elongated in shape and is substantially aligned with a radius of said disc, said slots being formed substantially transversely across said anvil.

30. The disc hog of claim 28 and wherein said anvil is elongated in shape and is oriented in skewed relationship to a radius of said disc, each of said slots being formed at a differing angle across said anvil depending upon the distance of the slot from the central axis of said disc.

31. The disc hog of claim 23 and wherein said means for expelling wood shards from the vicinity of said rear surface of said disc when the shards are reduced to a predetermined maximum size comprises a grate disposed adjacent to said rear surface of said disc, said grate having a multitude of holes formed therethrough and being sized to confine shards to the vicinity of said rear surface of said disc until the shards are reduced to a predetermined maximum size sufficiently small to pass through said grate and be expelled from said disc hog.

32. The disc hog of claim 23 and wherein said first pulverizing means comprises sets of knives.

33. The disc hog of claim 32 and wherein said means for transferring wood shards comprises gullets formed through said disc in the vicinity of said knives.

* * * * *